US005441672A

United States Patent [19]

Schwadtke et al.

[11] Patent Number: 5,441,672

[45] Date of Patent: Aug. 15, 1995

[54] CONCENTRATED WATER-CONTAINING LIQUID DETERGENT

[75] Inventors: Karl Schwadtke, Leverkusen; Eric Sung, Monheim, both of Germany

[73] Assignee: Henkel Kommanditgesellschaft auf Aktien, Duesseldorf, Germany

[21] Appl. No.: 142,413

[22] PCT Filed: May 14, 1992

[86] PCT No.: PCT/EP92/01055

§ 371 Date: Nov. 24, 1993

§ 102(e) Date: Nov. 24, 1993

[87] PCT Pub. No.: WO92/20769

PCT Pub. Date: Nov. 26, 1992

[30] Foreign Application Priority Data

May 23, 1991 [DE] Germany ..... 41 16 807.0

[51] Int. Cl.[6] ..... C11D 1/122; C11D 3/37; C11D 1/12

[52] U.S. Cl. ..... 252/550; 252/174.23; 252/174.24; 252/174.21; 252/174.17; 252/DIG. 2; 252/DIG. 14; 252/173

[58] Field of Search ..... 252/174.23, 174.24, 252/550, 174.21, 174.17, DIG. 2, DIG. 14, 173

[56] References Cited

U.S. PATENT DOCUMENTS

| | | | |
|---|---|---|---|
| 4,411,831 | 10/1983 | Robinson et al. | 252/554 |
| 5,008,032 | 4/1991 | Diessel et al. | 252/174.24 |
| 5,179,201 | 1/1993 | Oftring et al. | 536/41 |

FOREIGN PATENT DOCUMENTS

| | | |
|---|---|---|
| 0000215 | 1/1979 | European Pat. Off. . |
| 0243685 | 11/1987 | European Pat. Off. . |
| 0346995 | 12/1989 | European Pat. Off. . |
| 0367049 | 5/1990 | European Pat. Off. . |
| 5763400 | 4/1982 | Japan . |
| 2185991 | 8/1987 | United Kingdom . |

*Primary Examiner*—Paul Lieberman
*Assistant Examiner*—Kery Fries
*Attorney, Agent, or Firm*—Wayne C. Jaeschke; John E. Drach; Henry E. Millson, Jr.

[57] ABSTRACT

A concentrated aqueous liquid detergent containing 8 to 25% by weight of a $C_{12-18}$ alkane sulfonate, 21 to 32% by weight of an ethoxylated fatty alcohol, 5 to 10% by weight of a partly esterified copolymer, and optionally 1 to 22% by weight other surfactants. The partially esterified copolymer is a copolymer of a $C_{4-26}$ olefin or a mixture of a $C_{4-28}$ olefin and up to 20 mole percent of a $C_{1-28}$ alkyl vinyl ether, and an ethylenically unsaturated dicarboxylic anhydride having from 4 to 8 carbon atoms.

13 Claims, No Drawings

CONCENTRATED WATER-CONTAINING LIQUID DETERGENT

BACKGROUND OF THE INVENTION

1. Field of the Invention

This invention relates to a homogeneous, concentrated water-containing liquid detergent and to its use for the manual and machine washing of fabrics.

2. Statement of Related Art

Liquid water-containing laundry detergents containing anionic and nonionic surfactants are well known, European patent application EP 367 049 (BASF) describes liquid detergents containing anionic and nonionic surfactants and a special partly esterified copolymer. These liquid detergents consist of clear, aqueous, generally alkaline solutions which are stable in storage and which have an improved primary and secondary washing effect compared with state-of-the-art detergents. The concentrated water-containing liquid detergents described in this document contain 10 to 30% by weight typical anionic surfactants and 5 to 20% By weight nonionic surfactants and 0.1 to 20% by weight partly esterified copolymer.

Water-containing liquid detergents which contain a mixture of anionic and nonionic surfactants and in which the content of nonionic surfactants, based on the liquid detergent as a whole, is more than 20% by weight generally have inhomogeneities which cause phase separation of the liquid detergent, for example separation into two clear liquid phases or the flocculation of a solid. This phase separation occurs either directly during production, during storage for several weeks (instability in storage) or on dilution with water.

It has now been found that concentrated aqueous liquid detergents having a nonionic surfactant content above 20% by weight do not have the disadvantages mentioned above providing they contain a certain surface-active sulfonate.

DESCRIPTION OF THE INVENTION

Accordingly, the present invention relates to a concentrated aqueous liquid detergent containing anionic and nonionic surfactants and a partly esterified copolymer, characterized in that it contains 8 to 25% by weight of a $C_{12-18}$ alkane sulfonate, 21 to 32% by weight of an ethoxylated fatty alcohol, 5 to 20% by weight of the partly esterified copolymer and optionally 1 to 22% by weight other surfactants.

The concentrated water-containing liquid detergents preferably contain at least 35% by weight and, in particular, between 40 and 55% by weight surfactants. The detergents are homogeneous, stable in storage (stability tested both at room temperature and at extremely low temperatures of 5° to 40° C. over a period of at least 3 months) and show no tendency towards phase separation, even on dilution with water. They may be used manually and in machines either in concentrated form or, if desired by the consumer, in dilute form. Thus, the consumer may use the concentrate either directly and in a quantity smaller than the quantity in which commercially available non-concentrated liquid detergents are used or, alternatively, may transfer the concentrate to a bottle with a larger volume, for example twice the volume, may fill the bottle with water to the desired degree of dilution of the concentrate and then use the diluted detergent, which is also stable in storage, in the quantities in which conventional, non-concentrated water-containing liquid detergents have hitherto normally been used. The liquid concentrates are preferably diluted with water in a ratio of 1:2 to 1:1. In machine washing processes, the concentrated liquid detergents are either dispensed from the dispensing compartment of the washing machine or from a commercial external dispensing unit, for example a dispensing ball.

The readily biodegradable alkane sulfonates are obtained from $C_{12-18}$ alkanes, for example by sulfochlorination or sulfoxidation with subsequent hydrolysis and neutralization. The sulfonate group is statistically distributed over the entire carbon chain, the secondary alkane sulfonates predominating. The concentrated water-containing liquid detergents preferably contain 8 to 20% by weight and, more preferably, 10 to 16% by weight alkane sulfonate.

Preferred ethoxylated fatty alcohols are adducts of 1 to 10 mol ethylene oxide with primary $C_{12-18}$ fatty alcohols and mixtures thereof, such as coconut oil alcohol, tallow fatty alcohol or oleyl alcohol, or with 2-methyl-branched primary alcohols (oxoalcohols). $C_{12-14}$ alcohols . 3 EO or . 4 EO, $C_{13-15}$ alcohols . 3, 5 or 7 EO, $C_{12-18}$ alcohols . 3, 5 or 7 EO and mixtures thereof, such as mixtures of $C_{12-14}$ alcohol . 3 EO and $C_{12-18}$ alcohol . 5 EO, are particularly preferred. The concentrated liquid detergents preferably contain 21 to 30% by weight and, more particularly, 22 to 28% by weight ethoxylated nonionic surfactants.

The partly esterified copolymers used may be obtained in accordance with the teaching of European patent application EP 367 049 (BASF) by copolymerization of (a) at least one $C_{4-28}$ olefin or mixtures of at least one $C_{4-28}$ olefin with up to 20 mol-% $C_{1-28}$ alkyl vinyl ethers and (b) ethylenically unsaturated dicarboxylic anhydrides containing 4 to 8 carbon atoms in a molar ratio of 1:1 to copolymers having K values of 6 to 100 (as determined in accordance with H. Fikentscher in tetrahydrofuran at 25° C. and with a polymer concentration of 1% by weight) and subsequent partial esterification of the copolymers with reaction products of (A) $C_{2-4}$ alcohols, $C_{8-22}$ fatty acids, $C_{1-12}$ alkylphenols, secondary $C_{2-30}$ amines or mixtures thereof with (B) at least one $C_{2-4}$ alkylene oxide or tetrahydrofuran in a molar ratio (A) to (B) of 1:2 to 50 and hydrolysis of the anhydride groups of the copolymers to carboxyl groups, the partial esterification of the copolymers being continued until 5 to 50% of the carboxyl groups of the copolymers are esterified. Esterification with reaction products of (A) $C_{1-30}$ alcohols, more particularly $C_{8-18}$ fatty alcohols, with (B) $C_{2-4}$ alkylene oxide, more particularly ethylene oxide, is preferred. Non-alkoxylated fatty alcohols may also be used. Preferred copolymers contain maleic anhydride as the ethylenically unsaturated dicarboxylic anhydride (b). The partly esterified copolymers may be present either in the form of the free acid or preferably in partly or completely neutralized form. The copolymers are advantageously used in the form of an aqueous solution, more particularly a 40 to 50% by weight solution. The copolymers not only contribute to the primary and secondary washing effect of the liquid detergent, they also produce a desirable reduction in the viscosity of the concentrated water-containing liquid detergent. Concentrated water-containing liquid detergents, which flow freely under the sole effect of gravity, i.e. in the absence of other shear forces, are obtained by the use of these partly esterified copolymers. The concentrated water-containing liquid detergents preferably contain partly esterified copolymers in quantities of 5 to 15% by weight and, more particularly, in quantities of 8 to 12% by weight.

Other suitable anionic surfactants are, in particular, soaps, preferably in quantities of 8 to 20% by weight and more particularly in quantities of 10 to 15% by weight. Suitable soaps are saturated fatty acid soaps, such as the salts of lauric acid, myristic acid, palmitic acid or stearic acid, more particularly soap mixtures derived from natural fatty acids, for example coconut oil, palm kernel oil or tallow fatty acids. Soap mixtures of which 50 to 100% by weight consist of $C_{12-18}$ fatty acid soaps and 0 to 50% by weight of oleic acid soap are particularly preferred.

The concentrated water-containing liquid detergents may also contain other typical anionic surfactants, such as alkyl benzenesulfonates, fatty alkyl sulfates or esters of α-sulfofatty acids (ester sulfonates) or a-sulfofatty acid disalts, in small quantities preferably not exceeding 5% by weight.

The anionic surfactants may be present in the form of their sodium, potassium or ammonium salts and as soluble salts of organic bases, such as mono-, di- or triethanolamine.

The anionic surfactants are preferably present in the form of their sodium salts.

Alkyl glucosides corresponding to the general formula $RO(G)_x$, in which R is a primary linear or 2-methyl-branched aliphatic radical containing 8 to 22 and preferably 12 to 18 carbon atoms and G is a symbol standing for a glucose Unit, may also be used as further nonionic surfactants. The degree of oligomerization x, which indicates the=distribution of monoglucosides and oligoglucosides, is a number of 1 to 10 and preferably has a value of 1.2 to 1.4. The concentrated water-containing liquid detergents may preferably contain 1 to 5% by weight alkyl glucoside.

The water content of the detergents is preferably from 15 to 40% by weight and, more preferably, from 20 to 37% by weight. In addition, the liquid detergents may contain an organic solvent of monohydric or polyhydric alcohols containing 1 to 4 carbon atoms. Preferred alcohols are ethanol, propane-1,2-diol, glycerol and mixtures thereof. The detergents preferably contain 2 to 12% by weight and more preferably 3 to 10% by weight ethanol or a mixture of ethanol and glycerol.

The pH value of the concentrated detergents according to the invention is generally in the range from 7 to 10.5, preferably in the range from 7 to 9.5 and more preferably in the range from 7 to 8.5. Higher pH values, for example above 9, may be adjusted by the use of small quantities of sodium hydroxide or alkaline salts, such as sodium carbonate and sodium silicate. The liquid detergents are clear liquids and can be poured under the sole effect of gravity. Their viscosity is generally below 1,000 mPas (Brookfield viscosimeter, spindle 1, 20 r.p.m., 20° C.). The viscosity of the detergents is preferably between 150 and 900 mPas and, more particularly, between 150 and 500 mPas.

In addition to the ingredients mentioned, the detergents may contain known additives typically used in detergents, for example salts of citric acid, salts of polyphosphonic acids, optical brighteners, enzymes, enzyme stabilizers, small quantities of neutral filling salts and also dyes and fragrances, opacifiers and pearlescers.

The neutrally reacting sodium salts of, for example, 1-hydroxyethane-1,1-diphosphonate and diethylene triamine pentamethylene phosphonate are preferably used as the salts oft polyphosphonic acids in quantities of 0.1 to 1.5% by weight.

Suitable enzymes are enzymes from the class of proteases, lipases, amylases or mixtures thereof. They may be used in quantities of 0.2 to 2% by weight.

Where the detergents are used in machine washing processes, it can be of advantage to add typical foam inhibitors. Suitable foam inhibitors contain, for example, known organopolysiloxanes, paraffins or waxes.

In one preferred embodiment, the concentrated water-containing liquid detergents contain 8 to 16% by weight alkane sulfonate, 21 to 30% by weight ethoxylated nonionic surfactants, 8 to 14% by weight saturated soap or a soap mixture of saturated and unsaturated fatty acid soaps, 8 to 12% by weight partially esterified copolymer and 3 to 10% by weight ethanol or a mixture of ethanol and glycerol in any ratio.

In another preferred embodiment, the detergents additionally contain up to 2% by weight enzymes, more particularly 0.3 to 1.5% by weight protease and 0.1 to 0.5% by weight amylase.

A detergent additionally containing up to 1% by weight phosphonate and/or citrate is also preferred.

EXAMPLES

Liquid detergents M1 and M2 according to the invention and comparison detergents C1, C2 and C3 had the following compositions (in % by weight):

| | M1 | M2 | C1 | C2 | C3 |
|---|---|---|---|---|---|
| Alkane sulfonate, sodium salt (100% active substance; used as Hostapur SAS 93, a product of Hoechst, Federal Republic of Germany) | 13 | 8 | — | — | — |
| $C_{9-13}$ alkylbenzene sulfonate, sodium salt | — | — | 13 | 8 | — |
| $C_{12-14}$ fatty alkyl sulfate | — | — | — | — | 8 |
| $C_{12-18}$ fatty alcohol containing on average 7 EO | 25 | 26 | 25 | 26 | 26 |
| Oleic acid | 5.75 | 5.75 | 5.75 | 5.75 | 5.75 |
| Lauric acid | 5.75 | 5.75 | 5.75 | 5.75 | 5.75 |
| Sodium hydroxide | 1.8 | 1.8 | 1.8 | 1.8 | 1.8 |
| Partly esterified copolymer (100% active substance; used as Sokalan ES 9911 (45% by weight aqueous solution) disclosed in EP 367 049; a product of BASF, Federal Republic of Germany) | 10 | 10 | 10 | 10 | 10 |
| Ethanol | 5 | 6 | 5 | 6 | 6 |
| Protease | 0.8 | 0.8 | 0.8 | 0.8 | 0.8 |
| Amylase | 0.08 | 0.08 | 0.08 | 0.08 | 0.08 |
| Water | Balance to 100% by weight | | | | |
| pH | 7.9 | 7.6 | 7.5 | 7.9 | — |

The detergents were prepared by initially dissolving the sodium hydroxide in water at 80° C. The fatty acids were then added and neutralized. The partly esterified copolymer, the surface-active sulfonate or sulfate and the nonionic surfactant were then added in the order indicated. Before the addition of another component, the mixture was stirred until a homogeneous mixture was formed. After cooling to 50° C., ethanol was added. After further cooling to room temperature, the enzymes were added.

Detergents M1 and M2 according to the invention were also formulated with other typical ingredients of detergents, such as foam inhibitors, dyes and fragrances, pearlescers and 0.5 to 1% by weight phosphonate and 0.5 to 1% by weight sodium citrate to form marketable retail products. The foam inhibitor was added first together with the water, the citric acid was added after the partly esterified copolymer and the other constituents were added last together with or after the enzymes.

In another detergent according to the invention, the 2% by weight of alkane sulfonate in formulation M1 was replaced by 2% by weight of a $C_{12-14}$ alkyl glucoside with x=1.37.

The homogeneous detergents M1 and M2 according to the invention were stable in storage for 3 months both at room temperature and at 5° C. and 40° C. (stability test terminated after 3 months). The viscosity (Brookfield viscosimeter, 20° C., spindle 1, 20 r.p.m.) was 215 mPas for M1 and 200 mPas for M2. The detergents can be diluted with water in any desired ratio without phase separation occurring inside 4 weeks (stability test terminated after 4 weeks).

Comparison detergent C1 was inhomogeneous and formed two liquid phases after only 24 hours' storage at room temperature.

Comparison detergent C2 was stable in storage in concentrated form. On dilution with water in a ratio of 1:1, however, a white deposit was formed after 48 hours (room temperature).

Comparison detergent C3 could not be made up as a liquid detergent. When the fatty alkyl sulfate was added, the viscosity of the mixture increased to such an extent that it could no longer flow in the absence of shear forces (paste formation).

What is claimed is:

1. A concentrated water-containing liquid detergent comprising: (a) from about 8 to about 25% by weight of a $C_{12-18}$ alkane sulfonate; (b) from 21 to about 32% by weight of an $C_{12}$–$C_{18}$ fatty alcohol; (c) from about 5 to about 20% by weight of the partly esterified copolymer of (i) a $C_{4-28}$ olefin or a mixture of a $C_{4-28}$ olefin and up to 20 mole percent of a $C_{1-28}$ alkyl vinyl ether, and (ii) an ethylenically unsaturated dicarboxylic anhydride having from 4 to 8 carbon atoms, wherein the comonomer molar ratio of (i) to (ii) is about 1:1.

2. A concentrated water-containing liquid detergent comprising: (a) from about 8 to about 20% by weight of a $C_{12-18}$ alkane sulfonate; (b) from 21 to 30% by weight of an ethoxylated primary $C_{12-18}$ fatty alcohol having on average 1 to 10 moles of ethylene oxide; (c) from about 8 to about 20% by weight of a fatty acid soap; (d) from about 5 to 15% by weight of a partly esterified copolymer of, (i) a $C_{4-28}$ olefin or a mixture of a $C_{4-28}$ olefin and up to 20 mole percent of a $C_{1-28}$ alkyl vinyl ether, and (ii) an ethylenically unsaturated dicarboxylic anhydride having from 4 to 8 carbon atoms, wherein the comonomer molar ratio of (i) to (ii) is about 1:1.

3. The liquid detergent of claim 1 further comprising up to about 5% by weight of an alkylbenzene sulfonate, a fatty alkyl sulfate, an ester of α-sulfofatty acid or an α-sulfofatty acid disalt.

4. The liquid detergent of claim 2 further comprising from about 1 to about 5% by weight of an alkyl glucoside.

5. The liquid detergent of claim 2 further comprising up to about 5% by weight of an alkylbenzene sulfonate, a fatty alkyl sulfate, an ester of α-sulfofatty acid or an α-sulfofatty acid disalt.

6. The liquid detergent of claim 1 further comprising from about 1 to about 5% by weight of an alkyl glucoside.

7. A composition comprising said liquid detergent of claim 1 and water in a weight ratio of from about 1:1 to about 1:2.

8. The liquid detergent of claim 1 wherein from about 10 to about 16% by weight of component (a) is present therein.

9. The liquid detergent of claim 1 wherein from about 5 to about 15% by weight of component (c) is present therein.

10. The liquid detergent of claim 9 wherein from about 8 to about 12% by weight of component (c) is present therein.

11. The liquid detergent of claim 1 which contains from about 15 to about 40% by weight of water.

12. The liquid detergent of claim 11 which contains from about 20 to about 37% by weight of water.

13. The liquid detergent of claim 1 which contains from about 20 to about 37% by weight of water.

* * * * *